US006646669B2

(12) United States Patent
Gelbart

(10) Patent No.: US 6,646,669 B2
(45) **Date of Patent: *Nov. 11, 2003**

(54) MULTIMODE MULTI-TRACK OPTICAL RECORDING SYSTEM

(75) Inventor: Daniel Gelbart, Vancouver (CA)

(73) Assignee: Creo Inc., Burnaby (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,472

(22) Filed: Dec. 14, 2000

(65) Prior Publication Data

US 2002/0075378 A1 Jun. 20, 2002

(51) Int. Cl.[7] ..... B41J 15/14
(52) U.S. Cl. ..... 347/241
(58) Field of Search ..... 347/241, 244, 347/258; 359/663, 668, 207

(56) References Cited

U.S. PATENT DOCUMENTS 3,866,081 A * 2/1975 Hasker et al. ..... 313/449
5,319,528 A * 6/1994 Raven ..... 362/553
5,426,452 A 6/1995 Davis
5,475,416 A 12/1995 Kessler
5,517,359 A 5/1996 Gelbart
5,541,951 A * 7/1996 Juhasz et al. ..... 372/101
5,745,153 A 4/1998 Kessler
5,793,783 A 8/1998 Endriz
5,802,034 A 9/1998 Gelbart
5,831,659 A 11/1998 Baek
5,875,160 A 2/1999 Harigaya
5,923,475 A 7/1999 Kurtz
5,946,333 A 8/1999 Kappeler
5,986,819 A 11/1999 Steinblatt
5,995,475 A 11/1999 Gelbart
6,037,965 A 3/2000 Gross
6,064,528 A 5/2000 Simpson
6,430,136 B1 * 8/2002 Gelbart ..... 369/112.01
6,502,319 B1 * 1/2003 Goodrich et al. ..... 33/286

* cited by examiner

*Primary Examiner*—Michael Nghiem
(74) *Attorney, Agent, or Firm*—Oyen Wiggs Green & Mutala

(57) ABSTRACT

A method and apparatus for an improved multimode multi-track optical recording system are disclosed. A monolithic array of individually addressable multimode laser diode stripes is imaged onto a recording media, where the individual diode stripe images form a plurality of tracks. Introduction of astigmatism between each multimode laser diode and the recording medium causes the diode stripe images to be relatively sharply focussed on their short axes, but less focussed on their elongated axes. This blurring of the diode stripe images on their elongated axes at the surface of the recording media overcomes near-field non-uniformity in the power distribution of the multimode diode, increasing the reliability and overall performance of the recording system.

44 Claims, 1 Drawing Sheet

MULTIMODE MULTI-TRACK OPTICAL RECORDING SYSTEM

FIELD OF THE INVENTION

The invention relates to multimode multi-track optical reading and recording using multimode laser diodes.

BACKGROUND OF THE INVENTION

Semiconductor laser diodes are available as single mode or multimode diodes. The radiation emissions of single mode laser diodes are effectively modelled as point sources and are diffraction limited in their divergence on all axes. In contrast, multimode diodes typically have laser junctions which emit radiation along stripes having an elongated axis and a short axis; for this reason multimode diodes are often referred to as "stripe" type laser diodes. Multimode laser diodes are diffraction limited in the direction perpendicular to the junction (their short axis), but have non-diffraction limited divergence in the direction parallel to the laser junction (their elongated axis).

The region through which radiation emitted from a diode's laser junction is permitted to escape into the environment surrounding the diode is referred to as the "emitting aperture" of the diode. The emitting aperture of a multimode diode is generally elongated and can comprise a single or continuous stripe, a collection of short stripes or even a collection of single mode laser junctions electrically connected in parallel. In this document, the phrases "multimode diode" and "multimode laser diode" should be understood to incorporate each of these different diode constructions. In addition, laser diodes can emit radiation of various different frequencies and any reference to "light" in this document should be understood to incorporate any radiation frequency. Furthermore, reference is made throughout this document to the "short axis" and the "elongated axis". These axes relate to the stripe shape of the emitting aperture of a multimode diode, but are also used as convenient references to directions in space (e.g. a direction may be described as being parallel to the elongated axis).

For recording applications, the principal advantage of using multimode laser diodes is that the radiation emitted from multimode diodes can be of substantially higher power than that emitted from single mode diodes. Obviously, higher power is a desirable quality for a recording operation, where heat or optical power alter the physical characteristics of the recording media. Despite this advantageous characteristic, multimode laser diodes are often problematic to use for image recording, because of difficulty associated with their non-uniform near-field power distribution. Not only is the near-field power distribution of a multimode diode non-uniform, but it typically changes with the age and usage of the diode. In an optical recording device, this non-uniformity of the near-field power distribution leads to an unacceptable phenomenon on the recording media known as "banding", where the recorded image may be significantly degraded. Because the non-uniform power distribution of multimode diodes may lead to data loss or corruption, most optical recording devices employ single mode laser diodes, despite their relatively low power.

Accordingly, there is a need to improve the performance of multimode laser optical recording to overcome difficulties associated with the non-uniformity in the near-field power distribution of multimode laser diodes.

Various attempts have been made in the prior art to address the non-uniformity of the near-field power distribution of multimode laser diodes. One solution to this problem is to combine several diode emitters onto a single focal area. In this manner, the overlapping or combining radiation from several diodes can be used to effectively "average out" the non-uniformities of any single diode. This "emitter combination" technique is exemplified by U.S. Pat. Nos. 5,517,359, 5,923,475, and 6,064,528, all of which employ several laser diodes to illuminate the entrance pupil of a light valve (also known as a "spatial light modulator"). U.S. Pat. No. 5,793,783 employs a similar emitter combination technique, using several diodes to directly illuminate a single spot on a recording surface.

The principal drawback with the emitter combination technique is that it is inefficient in terms of both energy and space. The energy inefficiency results from the overlap of radiation from several diodes onto a single focal area. Today's commercially available multimode laser diodes produce sufficient power to individually image many types of media (i.e. without combining radiation from several diodes). While, the redundancy of the emitter combination technique does achieve a inure uniform power distribution, it is inefficient, because an individual diode can supply sufficient energy to image the recording media, and any excess energy contributed by the overlapping radiation of several diodes is wasted. The spatial inefficiency results from the need to have several distinct diodes for each focal area.

A second technique demonstrated by the prior art to overcome the non-uniformity of the near-field distribution of multimode laser diodes is to simply image the diode's far-field power distribution rather than its near-field power distribution. This technique is exemplified in U.S. Pat. Nos. 5,745,153 and 5,995,475.

A drawback with imaging the far-field distribution of a multimode laser diode is that it requires a relatively large amount of space. For use in high resolution imaging applications, a relatively large far field pattern must be reduced to a small spot at the recording surface. To image the far-field power distribution of a laser diode and have a large amount of optical reduction requires a relatively long optical path length.

An additional drawback of imaging the far-field distribution is that it adds optical aberrations in both the short and elongated axes of the laser diode image. As mentioned above, the shape of the multimode laser diode junction causes the divergence of the diode radiation to be diffraction limited in a direction parallel to the short axis of the diode emitting aperture. Therefore, additional aberrations in the direction of the short axis of the diode emitting aperture are undesirable.

SUMMARY OF THE INVENTION

In accordance with the present invention, a monolithic array of individually addressable multimode laser diodes is employed to image the surface of a radiation sensitive material. The emitting apertures of the diodes each have a short axis and an elongated axis. Input information is received by each of the diodes and is incorporated into a radiation pattern emitted by that diode.

The radiation patterns of each diode are directed toward the radiation sensitive surface by an anamorphic optical subsystem. An anamorphic optical system has different magnification properties on its different axes. For example, a cylindrical lens has no magnification in the direction parallel to the axis of the cylinder. The anamorphic optical subsystem introduces an astigmatism into the radiation patterns of each of the diodes. At the surface of the radiation sensitive material, the astigmatism introduced by the anamorphic optical subsystem causes the images of the emitting apertures of the diodes to be more focused on their short axes than on their elongated axes. In this mariner, the information contained in the radiation patterns can be recorded onto the radiation sensitive material without revealing their near field non-uniformities.

Advantageously, the short axis of the radiation patterns of the diodes may be substantially focused.

Preferably, the images of the emitting apertures of the diodes may be blurred on their elongated axes, such that, at the surface of the radiation sensitive material, their power distribution in their elongated axes is substantially uniform.

Preferably, the elongated axes of the images of the emitting apertures of the diodes on the radiation sensitive material may be between 1 and 5 times the size that they would have been bad they been focused at the surface of the radiation sensitive material.

Advantageously, the optical subsystem may employ at least one cylindrical lens.

Advantageously, the optical recording system may be used to simultaneously record a plurality of data channels on die surface of the radiation sensitive material.

Another aspect of the present invention involves a method of optically recording information onto the surface of a radiation sensitive material using a monolithic array of individually addressable multimode laser diodes. An emitting aperture of each of the diodes has a short axis and an elongated axis.

The first step of the invention involves incorporating input information into the radiation patterns emitted by each of the diodes and optically directing those radiation patterns toward the radiation sensitive material. The next step involves introducing an astigmatism into the radiation patterns prior to their reaching the surface of the radiation sensitive material, such that, at the surface of the radiation sensitive material, the images of the emitting apertures of the diodes are more focused on their short axes than on their elongated axes. In this manner, the information contained in the radiation patterns can be recorded onto the radiation sensitive material without revealing their near field non-uniformities.

Advantageously, the short axis of the radiation patterns of the diodes may be substantially focused.

Another aspect of the present invention involves a method of optically recording information onto the surface of a radiation sensitive material using a monolithic array of individually addressable multimode laser diodes. An emitting aperture of each of the diodes has a short axis and an elongated axis.

The first step of the invention involves incorporating input information into the radiation patterns emitted by each of the diodes and optically directing those radiation patterns toward the radiation sensitive material. The next step involves focusing an image of each of the emitting apertures on its short axis on the surface of the radiation sensitive material, while simultaneously blurring an image of each of the emitting apertures on its elongated axis at the surface of the radiation sensitive material. In this manner, the information contained in the radiation patterns can be recorded onto the radiation sensitive material without revealing their near field non-uniformities.

These and other objects of the present invention will be better understood from the following more detailed description along with the drawings and the accompanying claims.

BRIEF DESCRIPTION OF THE DRAWINGS

FIG. 2-B depicts a substantially more uniform power distribution profile of the elongated axis of a multimode diode in accordance with the present invention.

DESCRIPTION OF THE PREFERRED EMBODIMENT

Figure 1:
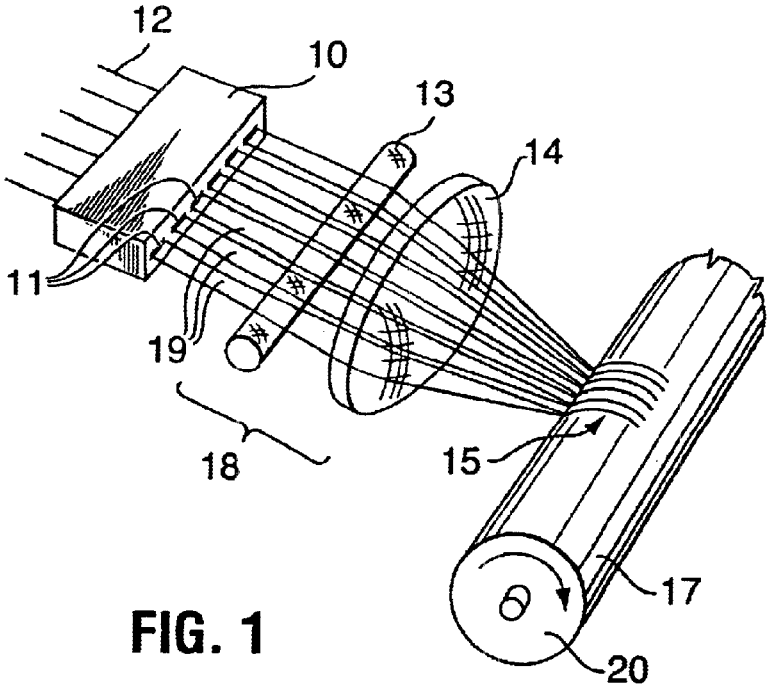
FIG. 1 depicts a preferred embodiment of the invention employed in a multimode multi-track optical recording system.
Figure 1A:
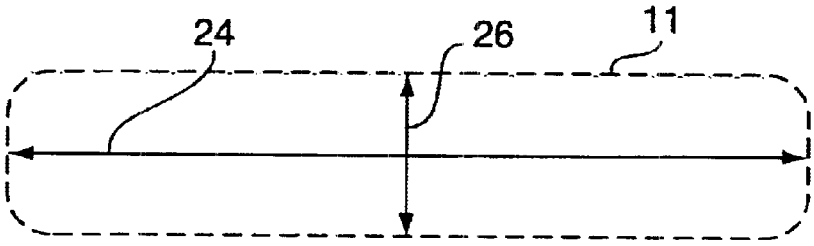
FIG. 1A is a schematic representation of the emitting aperture of a multimode diode.

Referring to FIG. 1, a preferred embodiment of the present invention is depicted. A monolithic array 10 of individually addressable multimode laser diodes. Each diode in array 10 receives data input (not shown) through a corresponding data line 12. Each diode in array 10 emits radiation through a corresponding elongated emitting aperture 11 to form a set of modulated light beams 19 which are directed toward optical system 18. At emitting apertures 11, the radiation patterns of light beams 19 produced by the multimode laser diodes coincide with the elongated shapes of diode emitting apertures 11. For this reason, emitting apertures 11 of the multimode diodes are often referred to as "light stripes" or "diode stripes". Any reference to a "diode stripe" in this description should be understood to refer to an elongated stripe shaped diode emitting aperture. A schematic illustration of a diode emitting aperture 11 is depicted in FIG. 1A. Diode emitting apertures 11 have an elongated axis 24 (the one parallel to the diode junction (not shown)) and a short axis 26 (perpendicular to the diode junction). The elongated axis 24 of diode emitting apertures 11 is often referred to as the "slow axis", because light emitted from multimode diodes diverges relatively slowly in the direction parallel to elongated axis 24. Not surprisingly, the short axis 26 of diode emitting apertures 11 is often referred to as the "fast axis", because light emitted from multimode diodes diverges relatively quickly in the direction parallel to the short axis 26.

Optical system 18 receives the data carrying light beams 19 and images them onto recording medium 17. The images of each diode stripe 11 are individually focussed into a particular channel 15 on recording medium 17. Recording medium 17 is mounted on a drum 20, which is rotated about its axis, providing a relative motion between recording medium 17 and optical system 18. As drum 20 rotates, the image data carried by light beams 19 is recorded onto recording medium 17 into a plurality of channels 15. After recording data into a first set of channels 15, relative motion between drum 20 and optical system 18 along the longitudinal axis of drum 24) creates a new set of channels 15. This procedure is repeated until the desired image (not shown) is imparted onto recording medium 17. Although the system depicted in FIG. 1 and described herein describes a particular type of imaging application, the novelty of the invention may be applied to many different optical recording systems and die invention should not be limited to recording images on the surface of a drum.

Optical system 18 is an anamorphic optical system, which may consist generally of any number of lenses or other optical elements. Anamorphic optical systems have different focal properties for different axes. Anamorphic optical system 18 introduces an astigmatism into light beams 19. This astigmatism manifests itself when data carrying light beams 19 are imaged into individual channels 15 on recording media 17. In this description, the images of diode stripes 11 at the surface of recording medium 17 are referred to as the "diode stripe images", because these images have an elognated striped shape similar to that of diode stripes 11 with a short axis and an elongated axis. An alternative design places microlenses (not shown) in front of diode stripes 11 in order to reduce the divergence of light beams 19. Such microlenses can be cylindrical thus forming part of the anamorphic system, spherical, or aspheric, not introducing astigmatism. In the latter case, there is a small astigmatism of the laser diode source, but the majority of the astigmatism is introduced by element 13.

An example of an anamorphic optical subsystem is the combination of a spherical lens 14 and a cylindrical lens 13 shown in FIG. 1. In general, there are many implementations of anamorphic optical systems and the invention should be considered to incorporate any anamorphic optical system providing the optical characteristics explained below.

The diode stripe images on recording medium 17 are also elongated in shape with short axes and elongated axes. The short axes of the diode stripe images are focussed sharply onto recording medium 17. However, because of the astigmatism introduced by anamorphic optical system 18, die elongated axes of the diode stripe images (i.e. the "slow axes") are UQI focused sharply. Consequently, on the surface of recording medium 17, the diode stripe images are slightly blurred on their elongated axes. The effect of the blurring results in an altered light intensity distribution along the elongated axes of the diode stripe images. The blurring effect is similar to the overlapping of adjacent point sources.

In general, the present invention should be understood to include the introduction of any aberration into an optical recording system, such that light from an array of multimode laser diodes is focussed relatively sharply along the short axes of the diode stripe images and is blurred along the elongated axes of the diode stripe images. Such an aberration could be produced by an astigmatism, but could also be generated by a "double image+ formed by micro-prisms or through diffraction, formed by a grating, or via any one of the well known optical methods which can cause a "smear "in the image.

Figure 2A:
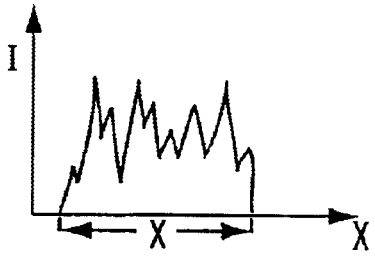
FIG. 2-A depicts a typical non-uniform near-field power distribution profile of the elongated axis of a multimode diode.
Figure 2B:
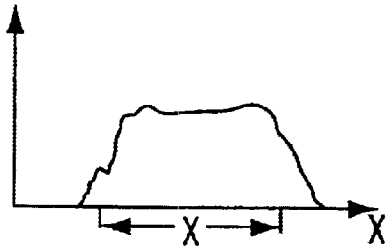

The typical non-uniform near-field intensity distribution of a diode stripe image (without astigmatism) is depicted in FIG. 2-A. FIG. 2-B depicts a corresponding intensity distribution of the elongated axis of a typical diode stripe image at the surface of recording medium 17 after an astigmatism is introduced by anamorphic optical system 18. The plot in FIG. 2-B demonstrates how the astigmatism introduced by anamorphic optical system 18 blurs the elongated axis of the diode stripe image and substantially reduces the non-uniformity of the power distribution in the diode stripe image. There is a small amount of undesirable blurring caused to the edges of the pixel X, which limits the amount of the desirable "smear" to be from 1 to 5 times the original unblurred length of pixel X.

Using the apparatus and method depicted in FIG. 1, the light received at the surface of recording medium 17 is relatively uniform (Le the near-field power distribution of the multimode laser diodes 11 is not revealed). For this reason, an improved multimode multi-track optical recording system can be implemented, which takes advantage of high power multimode diodes, without suffering from banding, data loss or data corruption on the recording media. In addition, the system of FIG. 1 does not involve the drawbacks of reduced spatial or energy efficiency present in some of the prior art emitter combination techniques, nor does it have the long optical path length or short axis blurriness associated with imaging the far-field distribution. Finally the system of FIG. 1 is suitable for high power recording applications, because it employs a distinct laser diode for each recording tack, thereby maximizing the amount of optical power available in each track on the recording surface.

It should be understood that the above description is intended for illustrative purposes only, and is not intended to limit the scope of the present invention in any way. Those skilled in the art will appreciate that various modifications can be made to the embodiments discussed above without departing from the spirit of the present invention.

What is claimed is:

1. An optical recording system for recording on a surface of a radiation sensitive material comprising:

(a) a monolithic diode array having a plurality of individually addressable multimode laser diodes, each of said diodes comprising an emitting aperture having a short axis and an elongated axis and each of said diodes operative to receive information and to emit a radiation pattern according to said information; and (b) an optical subsystem having at least one optical element, operative to direct each of said radiation patterns from said diodes to the surface of said radiation sensitive material, wherein said optical subsystem is configured to introduce astigmatism into said radiation patterns and to form, on the surface of said radiation sensitive material, an image of each of said emitting apertures that is substantially focused on its short axis and is blurred on its elongated axis, so as to record said information on the surface of said radiation sensitive material, while substantially avoiding revealing a near-field non-uniformity of said radiation patterns.

2. An optical recording system according to claim 1, wherein said optical subsystem is configured to blur each of said radiation patterns, such that, at the surface of said radiation sensitive material, the image of each of said emitting apertures has a power distribution that is substantially uniform over its elongated axis.

3. An optical recording system according to claim 1, wherein said optical subsystem is configured to blur each of said radiation patterns, such that, at the surface of said radiation sensitive material, the image of each of said emitting apertures is between 1 and 5 times larger on its elongated axis than it would have been had it been focused on its elongated axis.

4. An optical recording system according to claim 1, wherein said optical subsystem comprises at least one cylindrical lens.

5. An optical recording system according to claim 1, wherein said optical subsystem is configured to direct said radiation patterns to the surface of said radiation sensitive material, so as to simultaneously record said information in a plurality of data channels on the surface of said radiation sensitive material.

6. An optical recording system for recording on a surface of a radiation sensitive material comprising:

(a) a monolithic diode array having a plurality of individually addressable multimode laser diodes, each of said diodes comprising an emitting aperture having a short axis and an elongated axis and each of said diodes operative to receive information and to emit a radiation pattern incorporating said information; and (b) an optical subsystem having at least one optical element, operative to direct each of said radiation patterns from said diodes to the surface of said radiation sensitive material, wherein said optical subsystem is anamorphic and is configured to introduce en astigmatism into said radiation patterns and to form an image of said emitting apertures on the surface of said radiation sensitive material that is more focused on its short axis than on its elongated axis, so as to record said information on the surface of said radiation sensitive material, while substantially avoiding revealing a near-field non-uniformity of said radiation patterns.

7. An optical recording system according to claim 6, wherein said optical subsystem is configured to direct said radiation patterns, such that, at the surface of said radiation sensitive material, the image of each of said emitting apertures is substantially focussed on its short axis.

8. An optical recording system according to claim 6, wherein said optical subsystem is configured to blur each of said radiation patterns, such that, at the surface of said radiation sensitive material, the image of each of said emitting apertures has a power distribution that is substantially uniform over its elongated axis.

9. An optical recording system according to claim 6, wherein said optical subsystem is configured to blur each of said radiation patterns, such that, at the surface of said radiation sensitive material, the image of each of said emitting apertures is between 1 and 5 times larger on its elongated axis than it would have been had it been focused on its elongated axis.

10. An optical recording system according to claim 6, wherein said subsystem comprises at least one cylindrical lens.

11. An optical recording system according to claim 6, wherein said optical subsystem is configured to direct said radiation patterns to the surface of said radiation sensitive material, so as to simultaneously record said information in a plurality of data channels on the surface of said radiation sensitive material.

12. A method of optically recording information onto a surface of a radiation sensitive material using a monolithic array of individually addressable multimode laser diodes, each of said diodes comprising an emitting aperture having a short axis and an elongated axis, which method comprises:

(a) incorporating information into a radiation pattern emitted by each of said diodes;

(b) optically directing each of said radiation patterns from said diodes to the surface of said radiation sensitive material;

(c) introducing astigmatism into said radiation patterns prior to said radiation sensitive material, such that, at the surface of said radiation sensitive material, an image of each of said emitting apertures is substantially focused on its short axis and less focused on its elongated axis; and (d) recording said information on the surface of said radiation sensitive material, while substantially avoiding revealing a near-field non-uniformity of said radiation patterns.

13. A method according to claim 12, wherein introducing astigmatism into said radiation patterns causes the image of each of said emitting apertures, at the surface of said radiation sensitive material, to be between 1 and 5 times larger on its elongated axis than it would have been had it been focused on its elongated axis.

14. A method according to claim 12, wherein introducing astigmatism into said radiation patterns is accomplished using an anamorphic optical subsystem comprising at least one cylindrical lens.

15. A method of optically recording information onto a surface of a radiation sensitive material using a monolithic array of individually addressable multimode laser diodes, each of said diodes comprising an emitting aperture having a short axis and an elongated axis, which method comprises:

(a) incorporating information into a radiation pattern emitted by each of said diodes;

(b) optically directing each of said radiation patterns from said diodes to the surface of said radiation sensitive material, (c) introducing astigmatism into said radiation patterns prior to said radiation sensitive material, such that, at the surface of said radiation sensitive material, an image of each of said emitting apertures is more focused on its short axis than on its elongated axis; and (d) recording said information on the surface of said radiation sensitive material, while substantially avoiding revealing a near-field non-uniformity of said radiation patterns.

16. A method according to claim 15, wherein optically directing each of said radiation patterns and introducing astigmatism into said radiation patterns together comprise focusing said radiation patterns on at least one axis, such that, at the surface of said radiation sensitive material, the image of each of said emitting apertures is substantially focused on its short axis.

17. A method according to claim 15, wherein introducing astigmatism into said radiation patterns causes the image of each of said emitting apertures, at the surface of said radiation sensitive material, to be between 1 and 5 times larger on its elongated axis than it would have been had it been focused on its elongated axis.

18. A method according to claim 15, wherein introducing astigmatism into said radiation patterns is accomplished using an anamorphic optical subsystem comprising at least one cylindrical lens.

19. A method of optically recording information onto a surface of a radiation sensitive material using a monolithic array of individually addressable multimode laser diodes, each of said diodes comprising an emitting aperture having a short axis and an elongated axis, which method comprises (a) incorporating information into a radiation pattern emitted by each of said diodes;

(b) optically directing each of said radiation patterns from said diodes to the surface of said radiation sensitive material;

(c) focusing an image of each of said emitting apertures on its short axis at the surface of said radiation sensitive material;

(d) blurring the image of each of said emitting apertures on its elongated axis at the surface of said radiation sensitive material; and (e) recording said information on the surface of said radiation sensitive material, while substantially avoiding revealing a near-field non-uniformity of said radiation patterns.

20. An apparatus for recording images on a radiation sensitive material, the apparatus comprising:

an array of multimode diodes, each of the diodes comprising an emitting aperture having a short axis and an elongated axis; and an optical system disposed between the array of multimode diodes and the radiation sensitive material, the optical system configured to form an image of the emitting aperture of each diode on the radiation sensitive material and to thereby selectively cause a change in a state of the imageable material, the optical system comprising at least one optical element that introduces an optical aberration, such that the image of the emitting aperture of each diode is substantially focused on its short axis and is less focused on its elongated axis; and a mechanism for moving the images of the emitting apertures of the diodes relative to the radiation sensitive material so as to record an image on the radiation sensitive material.

21. An apparatus according to claim 20, wherein the at least one optical element comprises an anamorphic optical element and the optical aberration is astigmatism.

22. An apparatus according to claim 20, wherein the array of multimode diodes is monolithic.

23. An apparatus according to claim 20, wherein each of the diodes is individually addressable.

24. An apparatus according to claim 23, wherein each of the diodes is connected to receive corresponding image data and to emit a corresponding radiation beam modulated with the corresponding image data.

25. An apparatus according to claim 24, wherein the optical system is configured to direct each of the radiation beams into a corresponding channel on the radiation sensitive material.

26. An apparatus according to claim 20, wherein the optical system comprises at least one cylindrical lens.

27. An apparatus according to claim 20, wherein the optical system is configured to provide a substantially uniform power distribution over the elongated axis of the image of the emitting aperture of each diode.

28. An apparatus according to claim 20, wherein the optical system is configured to enlarge the image of the emitting aperture of each diode on its elongated axis to a size less than 5 times larger than it would have been if it bad been substantially focused on its elongated axis.

29. An apparatus according to claim 20, wherein the at least one optical element comprises a macro-prism and the optical aberration is a double image.

30. An apparatus according to claim 20, wherein the at least one optical element comprises a grating and the optical aberration is diffraction.

31. An apparatus for recording images on a radiation sensitive material, the apparatus comprising:

an array of multimode diodes, each of the diodes comprising an emitting aperture having a short axis and an elongated axis; and an optical system disposed between the array of multimode diodes and the radiation sensitive material, the optical system configured to form an image of the emitting aperture of each diode on the radiation sensitive material the optical system comprising at least one optical element that introduces an optical aberration, such that the image of the emitting aperture of each diode is substantially focused on its short axis and is less focused on its elongated axis;

wherein each of the diodes is individually addressable; wherein each of the diodes is connected to receive corresponding image data and to emit a corresponding radiation beam modulated with the corresponding image data; the optical system is configured to direct each of the radiation beams into a corresponding channel on the radiation sensitive material and the apparatus comprises means for moving the optical system relative to the radiation sensitive material in a scan direction, the relative motion in the scan direction causing each of the radiation beams to record corresponding image data at different locations in the corresponding channel.

32. An apparatus according to claim 31, wherein the means for moving the optical system relative to the radiation sensitive material is adapted to move the optical system in a direction orthogonal to the scan direction, the relative motion in the direction orthogonal to the scan direction causing each of the radiation beams to record corresponding image data in a different corresponding channel on the radiation sensitive material.

33. An apparatus according to claim 31, wherein the radiation sensitive material is disposed on a substantially cylindrical surface of a drum and wherein the drum is rotatable about a longitudinal axis to provide the relative motion in the scan direction.

34. A method of recording images comprising:

providing an array of multimode diodes, each of the diodes comprising an emitting aperture having a short axis and an elongated axis; and forming an image of the emitting aperture of each of the diodes on a radiation sensitive material, the image of the emitting aperture of each of the diodes being substantially focused on its short axis and less focused on its elongated axis, wherein forming an image of the emitting aperture of each diode comprises recording image data onto the radiation sensitive material.

35. A method according to claim 34, wherein forming an image of the emitting aperture of each diode comprises introducing an optical aberration between the array of multimode diodes and the radiation sensitive material.

36. A method according to claim 35, wherein introducing an optical aberration between the array of multimode diodes and the radiation sensitive material comprises one of: introducing an astigmatism; introducing a double image; and introducing diffraction.

37. A method according to claim 34, comprising providing each of the diodes with corresponding image data and emitting, from each diode, a radiation beam modulated with the corresponding image data.

38. A method according to claim 34, wherein forming an image of the emitting aperture of each diode comprises generating, on the radiation sensitive material, a power distribution that is substantially uniform over its elongated axis.

39. A method according to claim 34, wherein forming an image of the emitting aperture of each diode comprises forming an image which lacks near field non-uniformities in the intensity of radiation emitted by the emitting aperture.

40. A method according to claim 34, wherein forming an image of the emitting aperture of each diode comprises forming an enlarged image that is less than 5 times larger on its elongated axis than it would have been if it had been substantially focused on its elongated axis.

41. A method of recording images comprising:

providing an array of multimode diodes, each of the diodes comprising an emitting aperture having a short axis and an elongated axis; and forming an image of the emitting aperture of each of the diodes on a radiation sensitive material, the image of the emitting aperture of each of the diodes being substantially focused on its short axis and less focused on its elongated axis;

providing each of the diodes with corresponding image data and emitting, from each of the diode, a radiation beam modulated with the corresponding image data;

wherein forming an image of the emitting aperture of each diode comprises recording the image data corresponding with each diode into a corresponding data channel on the radiation sensitive material.

42. A method according to claim 41, comprising moving the radiation sensitive material and the array of multimode diodes relative to one another in a scan direction and recording the image data corresponding with each diode at different locations in its corresponding data channel.

43. A method according to claim 42, comprising moving the radiation sensitive material and the array of multimode diodes relative to one another in a direction orthogonal to the scan direction and recording the image data corresponding to each diode into a different corresponding data channel.

44. A method according to claim 42, wherein the radiation sensitive material is disposed on a substantially cylindrical surface of a drum and moving the radiation sensitive material and the array of multimode diodes relative to one another in a scan direction comprises rotating the drum about its longitudinal axis.

* * * * *